US011046475B2

(12) United States Patent
Vandewall et al.

(10) Patent No.: US 11,046,475 B2
(45) Date of Patent: Jun. 29, 2021

(54) MEAL PACKAGING AND PRESENTATION SYSTEMS AND METHODS

(71) Applicant: THE BOEING COMPANY, Chicago, IL (US)

(72) Inventors: Cynthia A. Vandewall, Snohomish, WA (US); Blake Lane, Cincinnati, OH (US); Craig Vogel, Cincinnati, OH (US); Leigh Ann Popik, Cincinnati, OH (US); Kristen McIntyre, Cincinnati, OH (US); Ryan Reese, Cincinnati, OH (US); Alberto De Icaza, Cincinnati, OH (US)

(73) Assignee: THE BOEING COMPANY, Chicago, IL (US)

( * ) Notice: Subject to any disclaimer, the term of this patent is extended or adjusted under 35 U.S.C. 154(b) by 60 days.

(21) Appl. No.: 16/167,641

(22) Filed: Oct. 23, 2018

(65) Prior Publication Data

US 2020/0122877 A1 Apr. 23, 2020

(51) Int. Cl.
*B65D 5/50* (2006.01)
*A45C 11/20* (2006.01)
(Continued)

(52) U.S. Cl.
CPC ..... *B65D 5/0236* (2013.01); *B65D 5/16* (2013.01); *B65D 5/4204* (2013.01);
(Continued)

(58) Field of Classification Search
CPC ..... B65D 5/16; B65D 5/0236; B65D 5/4233; B65D 77/0433; B65D 2203/02;
(Continued)

(56) References Cited

U.S. PATENT DOCUMENTS 3,608,770 A * 9/1971 Naimoli ..... A47J 39/006 220/575
3,627,541 A * 12/1971 Farquhar ..... B65D 5/2057 426/394
3,899,119 A * 8/1975 Roccaforte ..... B65D 5/6664 206/562
4,236,740 A * 12/1980 Sorenson ..... B65D 5/22 229/143

(Continued)

*Primary Examiner* — Luan K Bui
(74) *Attorney, Agent, or Firm* — The Small Patent Law Group LLC; Joseph M. Butscher

(57) ABSTRACT

A meal packaging and presentation system includes a base, a front panel connected to the base at a low front edge seam, a first side panel connected to the base at a first low side edge seam, a second side panel connected to the base at a second low side edge seam, a rear panel connected to the base at a low rear edge seam, a first top flap connected to the first side panel at a first top side edge seam, a second top flap connected to the second side panel at a second top side edge seam, a front top flap connected to the front panel at a top front edge seam, and a rear top flap that connects to the rear panel at a top rear edge. An interior meal chamber is formed between the base, the front panel, the first side panel, the second side panel, the rear panel, the first top flap, and the second top flap when the system is in a closed state. The system is configured to transition between the closed state and an opened presentation state through manipulation of the front panel, the first side panel, the second panel, the rear panel, the first top flap, the second top flap, the front top flap, and the rear top flap.

20 Claims, 7 Drawing Sheets

(51) Int. Cl.

| | |
|---|---|
| ***B65D 5/02*** | (2006.01) |
| ***B65D 5/42*** | (2006.01) |
| ***B65D 5/16*** | (2006.01) |
| ***B65D 77/04*** | (2006.01) |
| ***B65D 65/46*** | (2006.01) |

(52) U.S. Cl.
CPC ..... *B65D 5/4233* (2013.01); *B65D 65/46* (2013.01); *B65D 77/0433* (2013.01); *B65D 2203/02* (2013.01); *B65D 2203/06* (2013.01); *B65D 2401/05* (2020.05)

(58) Field of Classification Search
CPC .. B65D 2203/06; B65D 5/4204; B65D 65/46; B64D 11/0007; B64D 11/04
USPC ..... 206/45.28, 45.29, 541, 766, 767, 774, 206/544, 546, 548; 229/126, 127; 426/120
See application file for complete search history.

(56) References Cited

U.S. PATENT DOCUMENTS

| | | | | | |
|---|---|---|---|---|---|
| 4,346,756 | A * | 8/1982 | Dodd | A47J 39/006 | 126/268 |
| 4,397,159 | A * | 8/1983 | Dodd | A47J 39/006 | 165/48.1 |
| 4,985,232 | A * | 1/1991 | Jacobssen | A61B 10/00 | 206/219 |
| 5,123,540 | A * | 6/1992 | Karavias | A45C 7/0036 | 206/541 |
| 5,184,772 | A * | 2/1993 | McGrath | B65D 5/2057 | 229/127 |
| 5,228,617 | A * | 7/1993 | McGrath | B65D 5/2057 | 206/459.5 |
| 6,343,695 | B1 * | 2/2002 | Petrick | B42D 5/023 | 206/534 |
| 6,386,441 | B2 * | 5/2002 | Philips | B65D 5/6632 | 229/143 |
| 6,499,241 | B1 * | 12/2002 | Vila-Martinez | B65D 55/06 | 206/807 |
| 2014/0175101 | A1 * | 6/2014 | Dixon | B65D 5/6661 | 220/529 |

* cited by examiner

MEAL PACKAGING AND PRESENTATION SYSTEMS AND METHODS

FIELD OF THE DISCLOSURE

Embodiments of the present disclosure generally relate to systems and methods for packaging and presenting meals, such as may be delivered and served to passengers of a commercial aircraft.

BACKGROUND OF THE DISCLOSURE

Commercial aircraft transport passengers between locations. For example, an aircraft departs from a first airport and arrives at a second airport. During a flight, passengers may be provided food and beverage items, including meals, canned or bottled drinks, and the like. Typically, the aircraft operator provides a limited number of items for passengers to consume during a flight. As an example, flight attendants may offer passengers peanuts or other such snacks, along with a limited number of beverages. During certain longer flights, passengers may even be offered full meals.

Typically, catering companies contracted by airlines prepare meals for flight and transport them onto an aircraft. Passengers typically have limited food options and levels of customization onboard an aircraft. Flight attendants prepare the meals in galleys of the aircraft during a flight. For example, flight attendants may consult guidelines posted in galleys to prepare the meals and deliver them to certain passengers. The meals are generally served at pre-determined times during a flight.

Commercial aircraft are generally stocked with a relatively large amount of dishware and appliances, which adds weight to the aircraft. During a flight, flight attendants often prepare and present meals, which may be a time-consuming and tedious process. Further, after meal service, the flight attendants collect dishes, utensils, drinkware, and the like, and subsequently wash such items, such as after the aircraft has landed. Additionally, the flight attendants throw food and drink items away that the passengers did not consume during meal service.

During a flight, meals may not be efficiently delivered to passengers. For example, various items of a meal may be individually given to a passenger, who then positions such items on a limited space of an individual tray table associated within the passenger seat within the aircraft. Further, as noted, the process of preparing and presenting meals, as well as cleaning up after meal service may be tedious and time intensive for flight attendants.

SUMMARY OF THE DISCLOSURE

A need exists for a systems and methods for efficiently packaging and presenting meals to individuals, such as within a commercial aircraft. Further, a need exists for a system and method that reduces the need for flight attendants to prepare and present meals during a flight, thereby allowing the flight attendants to perform other tasks.

With those needs in mind, certain embodiments of the present disclosure provide a meal packaging and presentation system that includes a base, one or more panels coupled to the base, one or more flaps coupled to one or both of the one or more panels or the base. The base, the panel(s), and the flap(s) in a closed state define an interior meal chamber. In at least one embodiment, the interior meal chamber provides at least one snugly-fitting meal organizer. The panel(s) and the flap(s) are configured to dangle downwardly from the base when the base, the panel(s), and the flap(s) are in an opened presentation state.

In at least one embodiment, the panels and the flaps include a meal packaging and presentation system that includes a base, a front panel connected to the base at a low front edge seam, a first side panel connected to the base at a first low side edge seam, a second side panel connected to the base at a second low side edge seam, a rear panel connected to the base at a low rear edge seam, a first top flap connected to the first side panel at a first top side edge seam, a second top flap connected to the second side panel at a second top side edge seam, a front top flap connected to the front panel at a top front edge seam, and a rear top flap that connects to the rear panel at a top rear edge. The interior meal chamber is formed between the base, the front panel, the first side panel, the second side panel, the rear panel, the first top flap, and the second top flap when the meal packaging and presentation system is in a closed state. The meal packaging and presentation system is configured to transition between the closed state and an opened presentation state through manipulation of the front panel, the first side panel, the second side panel, the rear panel, the first top flap, the second top flap, the front top flap, and the rear top flap. The meal packaging and presentation system may be formed of recyclable or compostable cardboard.

A first interior edge of the first top flap may be proximate to a second interior edge of the second top flap when the meal packaging and presentation system is in the closed state. A seal may be secured over portions of the first top flap and the second top flap when the meal packaging and presentation system is in the closed state. The seal couples the first top flap and the second top flap together in a closed position.

In at least one embodiment, an indicator is configured to identify one or both of the contents within the interior meal chamber or an individual to whom the meal packaging and presentation system is to be served. The indicator may be secured to an exterior surface of the front panel.

One or more portions of the front panel, the first side panel, the second side panel, the rear panel, the first top flap, or the second top flap may be transparent.

In at least one embodiment, the meal packaging and presentation system in the closed state is sized and shaped to be received and retained within a compartment of a galley cart of a commercial aircraft.

In at least one embodiment, the first top flap is configured to be pivoted open laterally in relation to the first side panel about and along the first top side edge seam. The second top flap is configured to be pivoted open laterally in relation to the second side panel about and along the second top side edge seam. The front top flap is configured to be pivoted open forwardly in relation to the front panel. The rear top flap is configured to be pivoted open rearwardly in relation to the rear panel. The interior meal chamber is exposed when front top flap, the second top flap, the front top flap, and the rear top flap are opened.

In at least one embodiment, the meal packaging and presentation system also includes dishware within the interior meal chamber. The dishware may be formed of recyclable or compostable cardboard.

In at least one embodiment, the top front flap and the front panel are configured to be outwardly unfolded into a flattened position. The top front flap and the front panel outwardly unfolded into the flattened position may provide a lap protector.

In at least one embodiment, the first side panel and the second top flap are configured to be outwardly unfolded into a first flattened position. The second side panel and the second top flap are configured to be outwardly unfolded into a second flattened position.

The meal packaging and presentation system may also include one or more item stabilizing channels that are configured to retain dishware in a stable, upright position. The item stabilizing channel(s) may be formed through one or both of the rear panel and the rear top flap.

One or more of the low front edge seam, the first low side edge seam, the second low side edge seam, the low rear edge seam, the first top side edge seam, and the second top side edge seam may include perforations.

In at least one embodiment, interior surfaces of the base, the first top flap, the first side panel, the second side panel, and the second top flap provide a dining mat.

DETAILED DESCRIPTION OF THE DISCLOSURE

Figure 1:
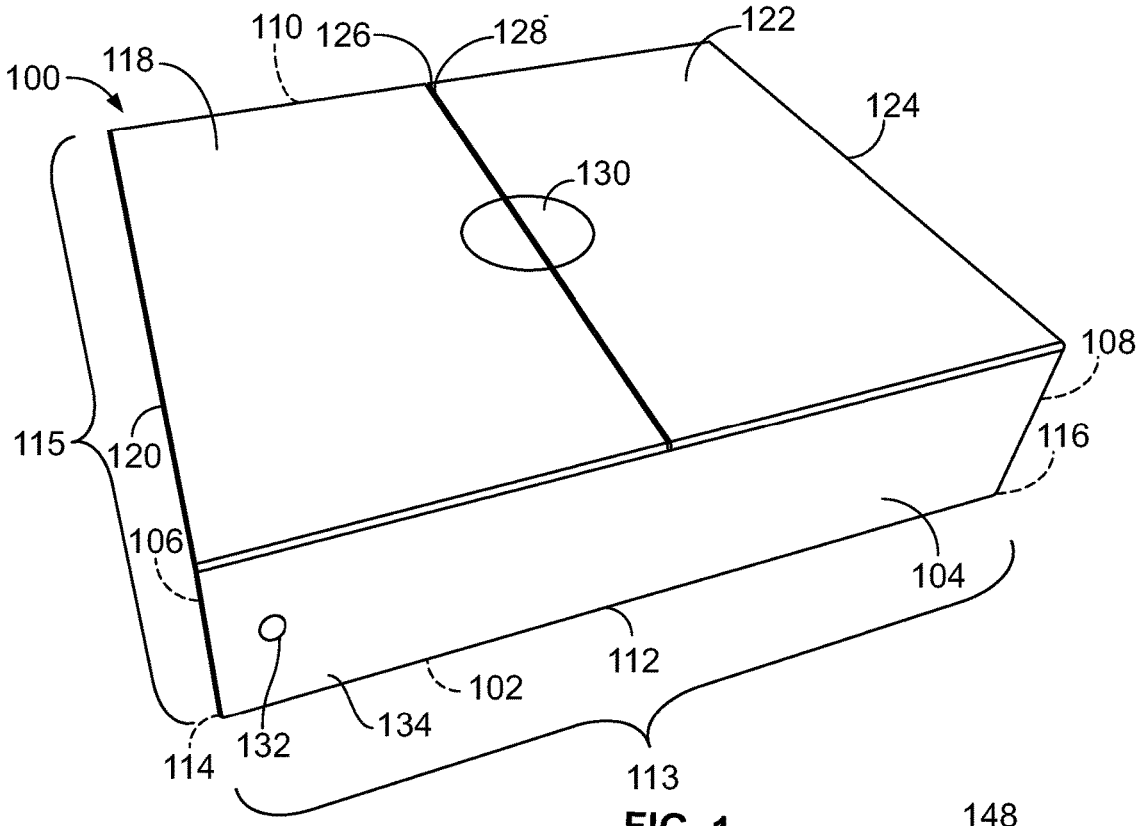
FIG. 1 illustrates a perspective top view of a meal packaging and presentation system in a closed state, according to an embodiment of the present disclosure.

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a meal packaging and presentation system that allows restaurants to package and present meals to passengers of a commercial aircraft. In at least one embodiment, the meal packaging and presentation system includes a foldable exterior and molded dishware. The exterior may have one or more portions that are transparent, thereby allowing individuals to see inside when the meal packaging and presentation system is in a closed state. The meal packaging and presentation system may be formed of a light-weight, recyclable material, such as compostable cardboard, that is configured to withstand heating or cooling temperatures associated with ensuring that the meals within are served to the passengers at desired hot or cold temperatures. For example, the meal packaging and presentation system is configured to withstand heating temperatures associated with an oven that heats certain food items, and cooling temperatures associated with a refrigerator or freezer that cools certain food items. In at least one embodiment, specialized orders may be placed by individuals, and fulfilled by desired restaurants. After the meal is secured within a closed meal packaging and presentation system, the meal packaging and presentation system may be labeled within an indicator, such as an adhesive label, writing, a radio frequency identification (RFID) tag, an electronic code, matrix barcode (such as a QR code) or the like that identifies the contained meal, and/or the individual to which the meal packaging and presentation system is to be served.

In at least one embodiment, after a meal is prepared and packaged within the meal packaging and presentation system, the closed meal packaging and presentation system may be inspected, sealed, and loaded into an appropriate galley cart, such as may be positioned within a galley of a commercial aircraft.

The meal packaging and presentation systems provide a desirable dining experience and eliminate, minimize, or reduce the need for flight attendants to move food items from cart to oven, and vice versa, and handle glassware and utensils. Embodiments of the present disclosure reduce overall weight of commercial aircraft, by reducing the need for inflight ovens and dishware, for example. Further, because the components of the meal packaging and presentation systems may be recyclable, after use, the components may be discarded, thereby reducing the need to store dirty service ware and indeterminate amounts of trash in the galley.

FIG. 1 illustrates a perspective top view of a meal packaging and presentation system 100 in a closed state, according to an embodiment of the present disclosure. The meal packaging and presentation system 100 includes a flat base 102 connected to a front panel 104, a first side panel 106, a second side panel 108, and a rear panel 110. The base 102 connects to the front panel 104 at a low front edge seam 112. The base 102 connects to the first side panel 106 and the second side panel 108 at a first low side edge seam 114 and a second low side edge seam 116, respectively. The base connects to the rear panel 110 at a low rear edge seam (hidden from view in FIG. 1).

A first top flap 118 connects to the first side panel 106 at a first top side edge seam 120. A second top flap 122 connects to the second side panel 108 at a second top side edge seam 124. In the closed state, a first interior edge 126 of the first top flap 118 abuts or is otherwise proximate to a second interior edge 128 of the second top flap 122.

In the closed state, the front panel 104, the first side panel 106, the second side panel 108, and the rear panel 110 upwardly extend from the base 102, such as at perpendicular orientations. That is, the front panel 104, the first side panel 106, the second side panel 108, and the rear panel 110 reside in planes that may be perpendicular to a plane in which the base 102 resides. Further, in the closed state, the first top flap 118 and the second top flap 122 extend perpendicularly from the first side panel 106 and the second side panel 108 over the base 102. As such, the first top flap 118 and the second top flap 122 reside in a plane that may be parallel to the plane of the base 102.

In the closed state, an interior meal chamber is formed between the base 102, the front panel 104, the first side panel 106, the second side panel 108, the rear panel 110, the first top flap 118, and the second top flap 122. A prepared meal may be positioned within the interior meal chamber. As shown, in the closed state, the meal packaging and presentation system 100 may provide an enclosed box. In the closed position, the base 102, the front panel 104, the first side panel, the second side panel, the rear panel 110, the first top flap 118, and the second top flap 122 define a rectangular cube. That is, the interior meal chamber is a rectangular cube. The base 102 is configured to be positioned on a tray table, such as that within a commercial aircraft. In at least one embodiment, the base 102 has dimensions (for example, a length 113 and a width 115) that are less than that of a tray table onboard a vehicle, such as a commercial aircraft. The interior meal chamber may include at least one snugly-fitting meal organizer that allows a prepared meal to fit snugly and securely within the interior meal chamber.

As shown, a seal 130 (such as an adhesive sticker, tape, wax member, or other such tamper-evident device) may be secured over portions of the first top flap 118 and the second top flap 122 proximate to the respective first interior edge 126 and the second interior edge 128. The seal 130 couples the first top flap 118 and the second top flap 122 together in a closed position. Further, the unbroken seal 130 provides a quality assurance indication that the contents within the interior meal chamber have not been tampered with after preparation and packaging.

An indicator 132 may be secured to the meal packaging and presentation system 100. For example, the indicator 132 may be adhesively secured to the meal packaging and presentation system 100. In at least one embodiment, the indicator 132 may be integrally formed with a portion of the meal packaging and presentation system 100. As shown, the indicator 132 may be located on an exterior surface 134 of the front panel 104. By positioning the indicator 132 on the front panel 104, the indicator 132 may be readily and easily viewed when positioned within a galley cart, for example. Alternatively, the indicator 132 may be positioned on various other portions of the meal packaging and presentation system 100, such as the first side panel 106, the second side panel 108, the rear panel 110, the first top flap 118, or the second top flap 122.

The indicator 132 is configured to identify the contents within the interior meal chamber and/or an individual (such as a passenger of a commercial aircraft) to whom the meal packaging and presentation system 100 is to be delivered and/or served. In at least one embodiment, the indicator 132 may be a label, such as adhesively secured to the front panel 104 that identifies (such as through text, graphics, or the like) the contents and/or the individual (by name, seat assignment, or the like) to which the meal packaging and presentation system 100 is to be delivered and/or served. In at least one other embodiment, the indicator 132 may be an RFID tag. In at least one other embodiment, the indicator 132 may be a bar code, an electronic code (for example, digital information), a matrix barcode, or the like. In general, the indicator 132 may be an inventory management device such as a code that may be scanned at various stages of preparation and presentation in order to provide information regarding status indication, indication of origin, and/or the like.

In at least one embodiment, one or more portions of the front panel 104, the first side panel 106, the second side panel 108, the rear panel 110, the first top flap 118, and the second top flap 122 may be transparent, thereby allowing individuals to see inside when the meal packaging and presentation system 100 is in the closed state. For example, openings may be formed through the first top flap 118 and the second top flap 122 to allow an individual to view internal contents.

Figure 2:
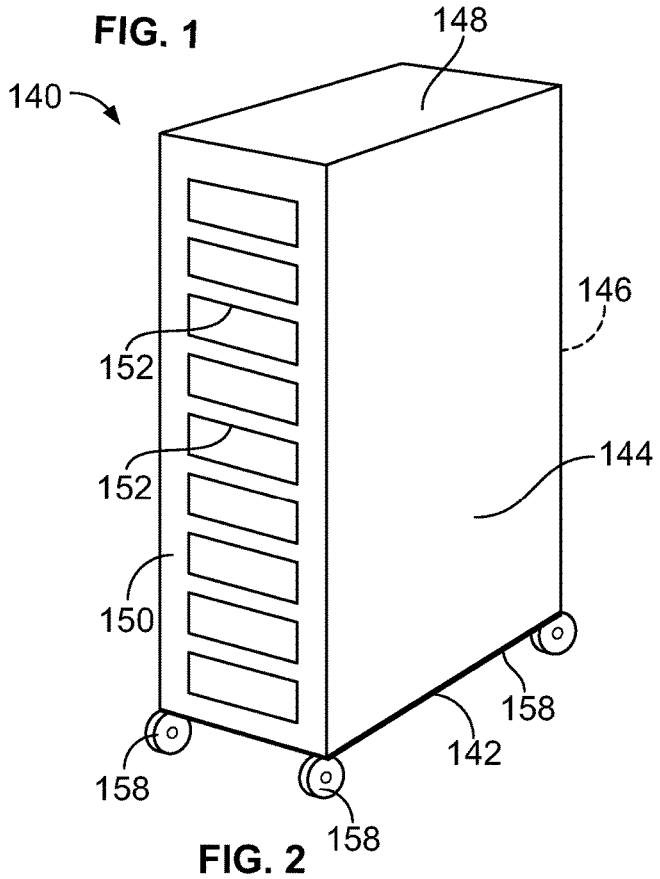
FIG. 2 illustrates a perspective front view of a cart, according to an embodiment of the present disclosure.

FIG. 2 illustrates a perspective front view of a cart 140, according to an embodiment of the present disclosure. The cart 140 may be a galley cart that is configured to be moveably positioned within an interior cabin of an aircraft. For example, the cart 140 may be positioned within a galley of the aircraft.

The cart 140 includes a base 142, lateral walls 144 upwardly extending from the base 142, a rear wall 146 upwardly extending from the base 142, and a top wall 148 connected to the lateral walls 144 and the rear wall 146. A front 150 of the cart 140 includes a plurality of compartments 152. Each compartment 152 is configured to receive and retain a separate meal packaging and presentation system 100 in the closed state (as shown in FIG. 1). The cart 140 may also include wheels 158 (such as casters) downwardly extending from the base 142, thereby allowing the cart 140 to be moved. Alternatively, the cart 140 may not include the wheels 158.

Referring to FIGS. 1 and 2, meal packaging and presentation system 100 in the closed state is configured to be removably positioned within a compartment 152. Each meal packaging and presentation system 100 in the closed state may be sized and shaped to fit within the compartment 152. In at least one embodiment, a standard size and shape may be used for each meal packaging and presentation system 100 in the closed state. The standard size and shape may correspond to a retaining compartment within a galley of a commercial aircraft. For example, the standard size and shape may be associated with the size and shape of the compartments 152. In this manner, numerous restaurants may prepare and package meals within the meal packaging and presentation system 100 and each prepared and packaged meal may be quickly and easily stored in the commercial aircraft, such as within the compartment 152 of the cart 140.

Figure 3:
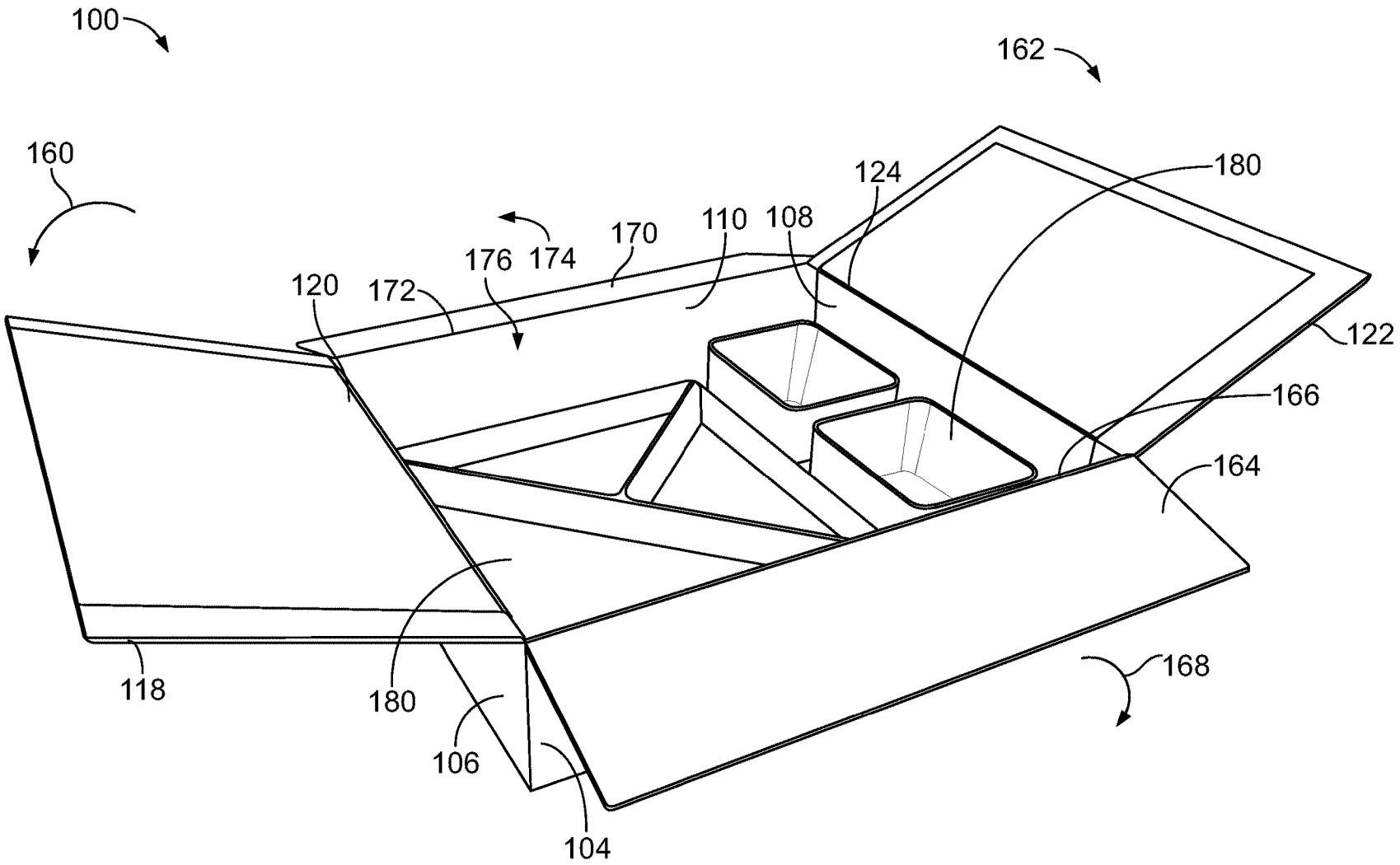
FIG. 3 illustrates a perspective top view of the meal packaging and presentation system in an initial opened state.

FIG. 3 illustrates a perspective top view of the meal packaging and presentation system 100 in an initial opened state. Referring to FIGS. 1 and 3, in order to initially open the meal packaging and presentation system 100, the first top flap 118 is grasped and pivoted open laterally in relation to the first side panel 106 about and along the first top side edge seam 120 in the direction of arc 160. Similarly, the second top flap 122 is grasped and pivoted open laterally in relation to the second side panel 108 about and along the second top side edge seam 124 in the direction of arc 162. Further, a front top flap 164 that connects to the front panel 104 at a top front edge seam 166 is grasped and pivoted open forwardly in relation to the front panel 104 in the direction of arc 168. Similarly, a rear top flap 170 that connects to the rear panel 110 at a top rear edge seam 172 is grasped and pivoted open rearwardly in relation to the rear panel 110 in the direction of arc 174. As the first top flap 118, the second top flap 122, the front top flap 164, and the rear top flap 170 are opened, the interior meal chamber 176 is exposed. As shown, the interior meal chamber 176 may be a rectangular cube. The interior meal chamber 176 provides at least one snugly-fitting meal organizer that allows a prepared meal to fit snugly and securely within the interior meal chamber. For example, the interior meal chamber 176 allows various items of dishware 180 to snugly, stably, and securely fit therein when the meal packaging and presentation system 100 is in the closed state.

Dishware 180, such as plates, bowls, cups, and/or the like, may be positioned within the interior meal chamber 176. The dishware 180 supports items to be consumed by an individual. The dishware 180 is positioned within the interior meal chamber 176 by a preparer (such as at a restaurant) to provide a desirable presentation. Thus, when used with a commercial aircraft, the meal may be prepared, presented, and packaged at a restaurant, instead of by a flight attendant, thereby freeing up the flight attendant for other tasks, duties, or even a break.

Further, the dishware 180 may be formed of a recyclable or compostable material. In at least one embodiment, the dishware 180 may be formed of compostable cardboard. As such, the dishware 180 may be discarded into a recycling bin after use. In this manner, a flight attendant may simply discard the meal packaging and presentation system 100, which may include the dishware 180, into recycling, instead of attending to stacking or sorting dishes, thereby saving the time and effort of the flight attendant.

Figure 4:
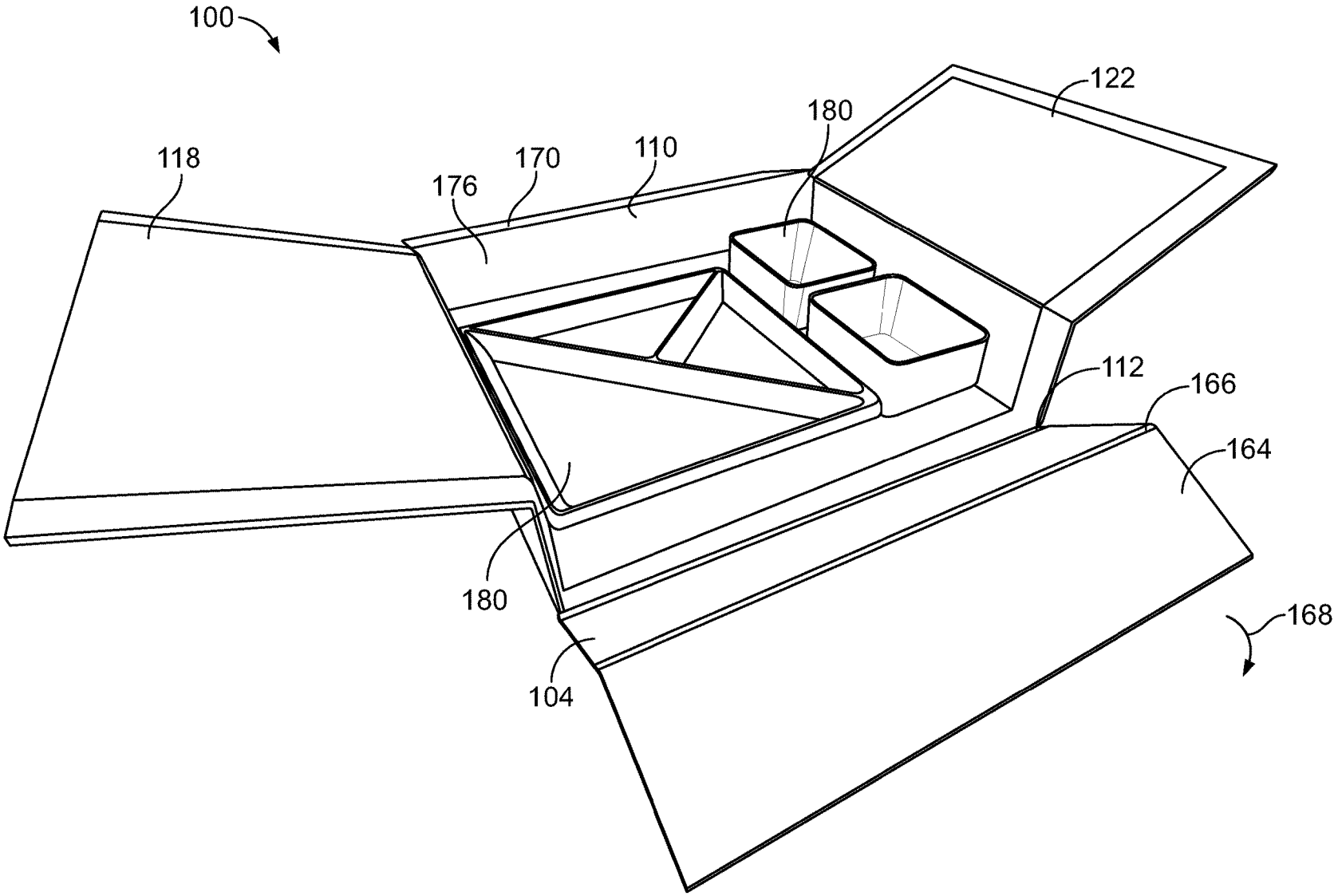
FIG. 4 illustrates a perspective top view of the meal packaging and presentation system in an intermediate opened state.

FIG. 4 illustrates a perspective top view of the meal packaging and presentation system 100 in an intermediate opened state. After the top front flap 164 is pivoted open as shown in FIG. 3, the top front flap 164 may continue to be urged in the direction of arc 168, thereby causing the front panel 104 to pivot open in the direction of arc 168 about and along the low front edge seam 112. During such motion, the top front flap 164 and the front panel 104 pivot into a flattened position.

Figure 5:
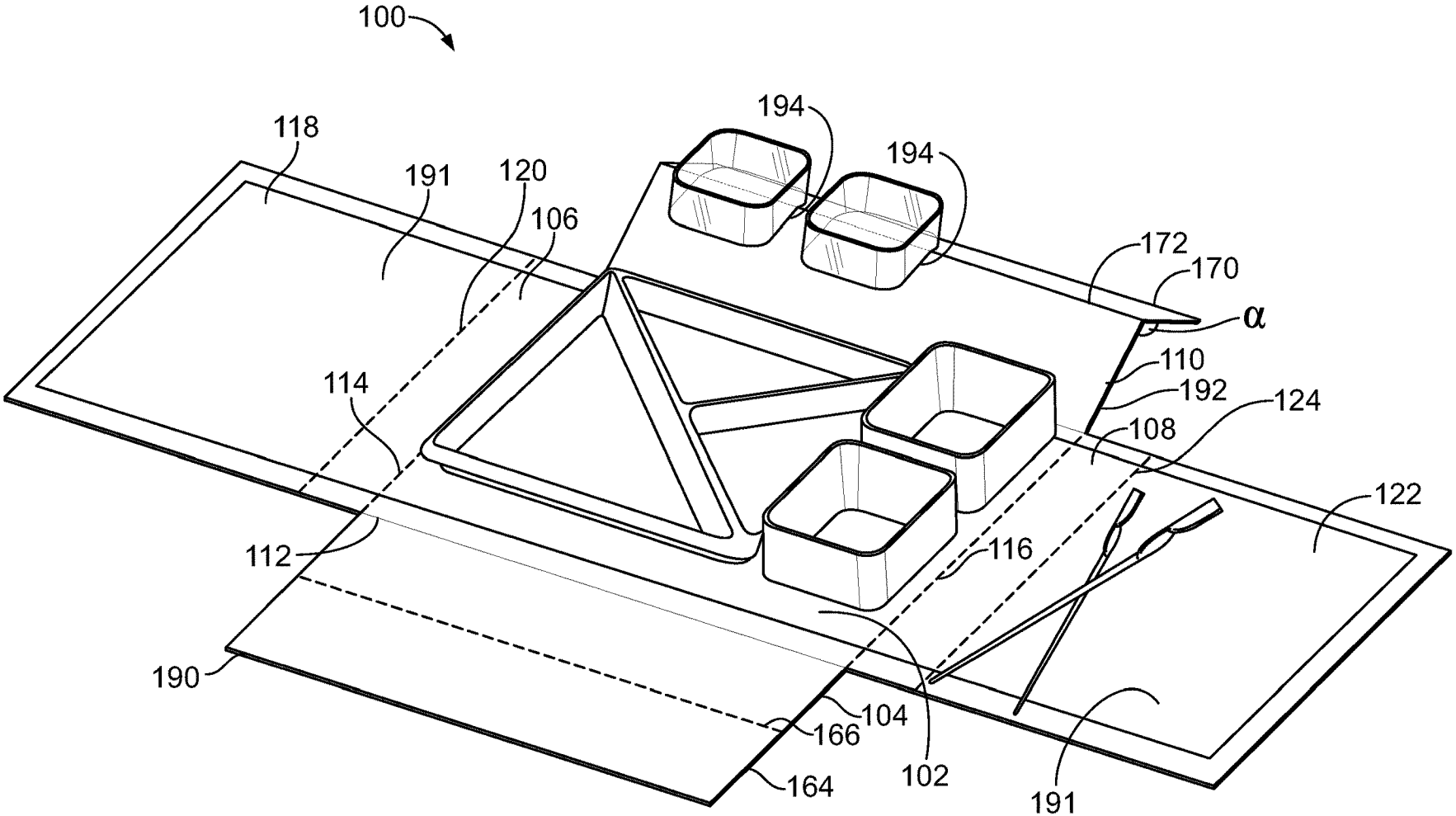
FIG. 5 illustrates a perspective top view of the meal packaging and presentation system in an opened presentation state.

FIG. 5 illustrates a perspective top view of the meal packaging and presentation system in an opened presentation state. As described herein, the meal packaging and presentation system 100 transitions between the closed state into the opened presentation state through manipulation of the front panel, the first side panel, the second panel, the rear panel, the first top flap, the second top flap, the front top flap, and the rear top flap.

In the opened presentation state, the top front flap 164 and the front panel 104 are outwardly unfolded into a flattened position, thereby providing a lap protector 190, which an individual may position over a lap to provide an integral napkin-like shield, for example. Optionally, the top front flap 164 and the front panel 104 may be folded under the base 102 about and along the low front edge seam 112.

As shown, the first side panel 106 and the first top flap 118 may also be outwardly unfolded into a flattened position. Optionally, the first top flap 118 and the first side panel 106 may be folded under the base 102 about and along the first low side edge seam 114.

Further, the second side panel 108 and the second top flap 122 may also be outwardly unfolded into a flattened position. Optionally, the second top flap 122 and the second side panel 108 may be folded under the base 102 about and along the second low side edge seam 116.

Additionally, the rear panel 110 and the rear top flap 170 may be outwardly unfolded into a flattened position. For example, the rear top flap 170 and the rear panel 110 may be folded under the base 102 about and along the low rear edge seam 192.

In at least one embodiment, one or more item stabilizing channels 194 is formed through portions of one or both of the rear panel 110 and the rear top flap 170, such as at and/or proximate to the top rear edge seam 172. Optionally and/or additionally, one or more item stabilizing channels 194 may be formed through portions of one or more of the first side panel 106, the first top flap 118, the second side panel 108, and/or the second top flap 122. In at least one embodiment, the stabilizing channels 194 may be formed by pushing out or otherwise removing portions of the rear panel 110 and the rear top flap 170, such as may be defined by perforations. The stabilizing channels 194 may be sized and shaped to retain certain dishware 180, such as a cup, can, bottle, or the like that is configured to retain a beverage in a stable, upright position. For example, the rear panel 110 and the rear top flap 170 may be outwardly unfolded into a propped position such that an angle a is formed therebetween. As such, the rear panel 110 and the rear top flap 170 are not flattened. In this manner, the interior edges the rear top flap 170 and the rear panel 110 that define the stabilizing channels 194 extend around intermediate or upper portions of the dishware 180 retained therein, thereby stably retaining the dishware 194 within the stabilizing channels 180. Alternatively, the meal packaging and presentation system 100 may not include the item stabilizing channel(s) 194.

Each of the seams provides an area where connected components may fold and unfold in relation to one another. One or more of the seams may be weakened areas that allow for flexibility and folding. In at least one embodiment, one or more of the seams may be a perforated line that allows for component folding, as described, as well as the ability for one component to be easily torn off. For example, in the opened presentation state, an individual may tear off the lap protector 190 along and about the low front edge seam 112, which may be or otherwise include a plurality of perforations.

Interior surfaces of the base 102 and the unfolded first top flap 118, the first side panel 106, the second side panel 108, and the second top flap 122 may provide or be covered with a dining mat 191. The dining mat 191 may include graphics, text, or the like that may be aesthetically pleasing. In at least one embodiment, interior surfaces of the meal packing and presentation system 100 (such as the dining mat 191) may include logos, marks, names, phrases or the like that provide an advertisement for a particular entity (such as an airline operator and/or a restaurant), thereby providing entities with additional branding and advertising opportunities.

In order to transition the meal packaging and presentation system 100 from the opened presentation state to the closed state, the opening process is reversed. For example, the various components of the meal packaging and presentation system 100 may be manipulated to form the enclosed box shown in FIG. 1.

As shown in FIG. 5, the unfolded first top flap 118, the first side panel 106, the second side panel, the second top flap 122, the rear panel 110, the rear top flap 170, the front flap 104, and the front top flap 104 are foldably joined to the base 102. As such, the panels and flaps are able to dangle downwardly from an edge of the tray table on which the base 102 is supported. That is, the meal packaging and presentation system comprises one or more flaps and panels that are foldably coupled to the base 102 so as to dangle downwardly from the tray table, so as to void invading neighboring passengers' space and/or overlapping onto neighboring tray tables.

Figure 6:
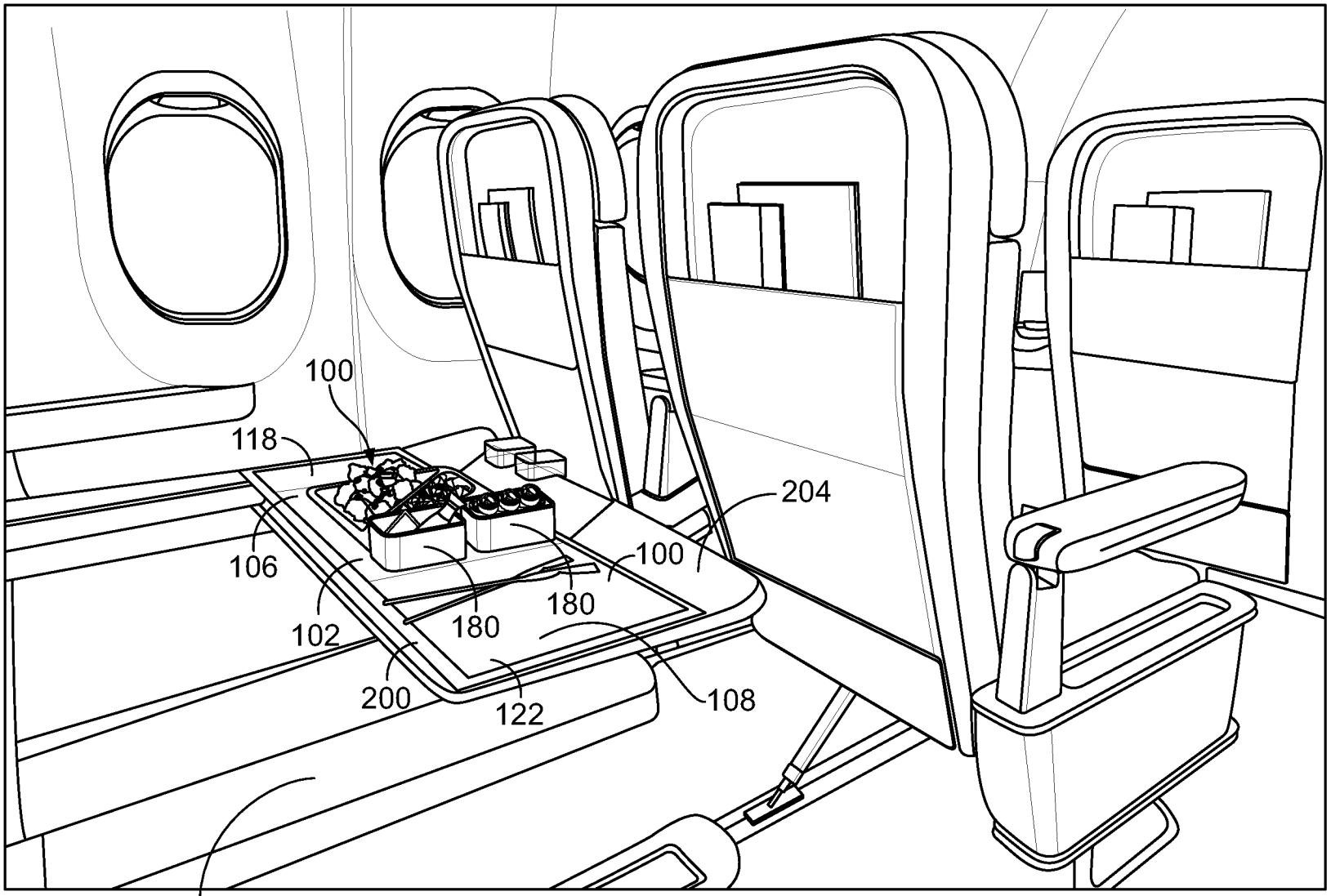
FIG. 6 illustrates a perspective view of the meal packaging and presentation system in the opened presentation state supported on a tray table associated with a passenger seat within an interior cabin of a vehicle, according to an embodiment of the present disclosure.

FIG. 6 illustrates a perspective view of the meal packaging and presentation system 100 in the opened presentation state supported on a tray table 200 associated with a passenger seat 202 within an interior cabin of a vehicle, according to an embodiment of the present disclosure. In the opened presentation state, the meal packaging and presentation system 100 is configured to be supported on a top surface 204 of the tray table 200. As shown and described, portions of the meal packaging and presentation system 100 unfold to provide an attractive dining experience. In at least one embodiment, the meal packaging and presentation system 100 may be sized and shaped such that the flattened base 102, the flattened first side panel 106, the flattened first top flap 118, the flattened second side panel 108, and the flattened second top flap 122 are fully supported by the top surface 204 of the tray table 200. Optionally, the meal packaging and presentation system 100 may be sized and shaped such that the base 102 is fully supported by the top surface 204, but less than all of the flattened first side panel 106, the flattened first top flap 118, the flattened second side panel 108, and the flattened second top flap 122 are fully supported by the top surface 204. The base 102 has dimensions that are less than a top surface of the tray table 200. Thus, when the base 102 is supported by the tray table 200, the base 102 may not hang over and past exterior edges of the tray table 200.

Figure 7:
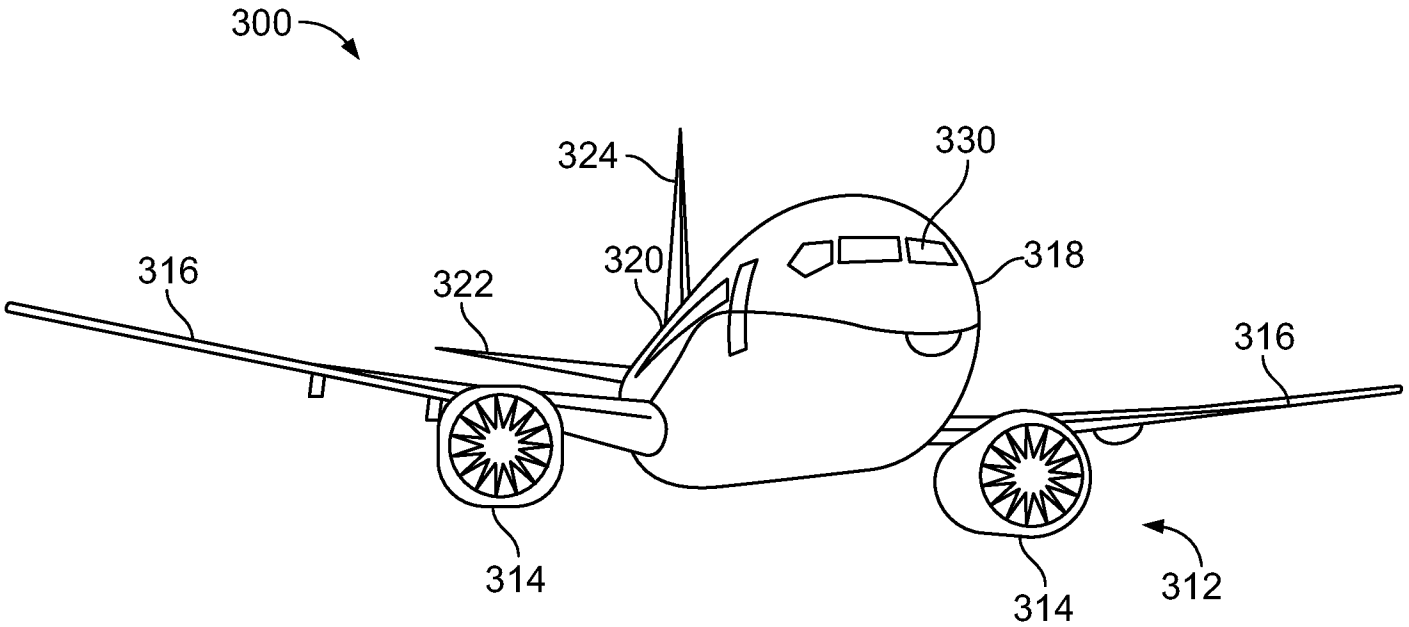
FIG. 7 illustrates a front perspective view of an aircraft, according to an exemplary embodiment of the present disclosure.

FIG. 7 illustrates a front perspective view of an aircraft 300, according to an exemplary embodiment of the present disclosure. The aircraft 300 includes a propulsion system 312 that may include two turbofan engines 314, for example. Optionally, the propulsion system 312 may include more engines 314 than shown. The engines 314 are carried by wings 316 of the aircraft 300. In other embodiments, the engines 314 may be carried by a fuselage 318 and/or an empennage 320. The empennage 320 may also support horizontal stabilizers 322 and a vertical stabilizer 324. The fuselage 318 of the aircraft 300 defines an interior cabin, which may include a cockpit 330. Passengers that are scheduled to fly on the aircraft 300 may order meals that are packaged and presented within the meal packaging and presentation systems 100 described herein.

Embodiments of the present disclosure may be used with aircraft 300 other than shown. The aircraft 300 shown in FIG. 7 is merely an example of one type of commercial aircraft. Embodiments of the present disclosure may be used with various other vehicles, such as automobiles (including buses), trains, watercraft, and/or the like.

Figure 8:
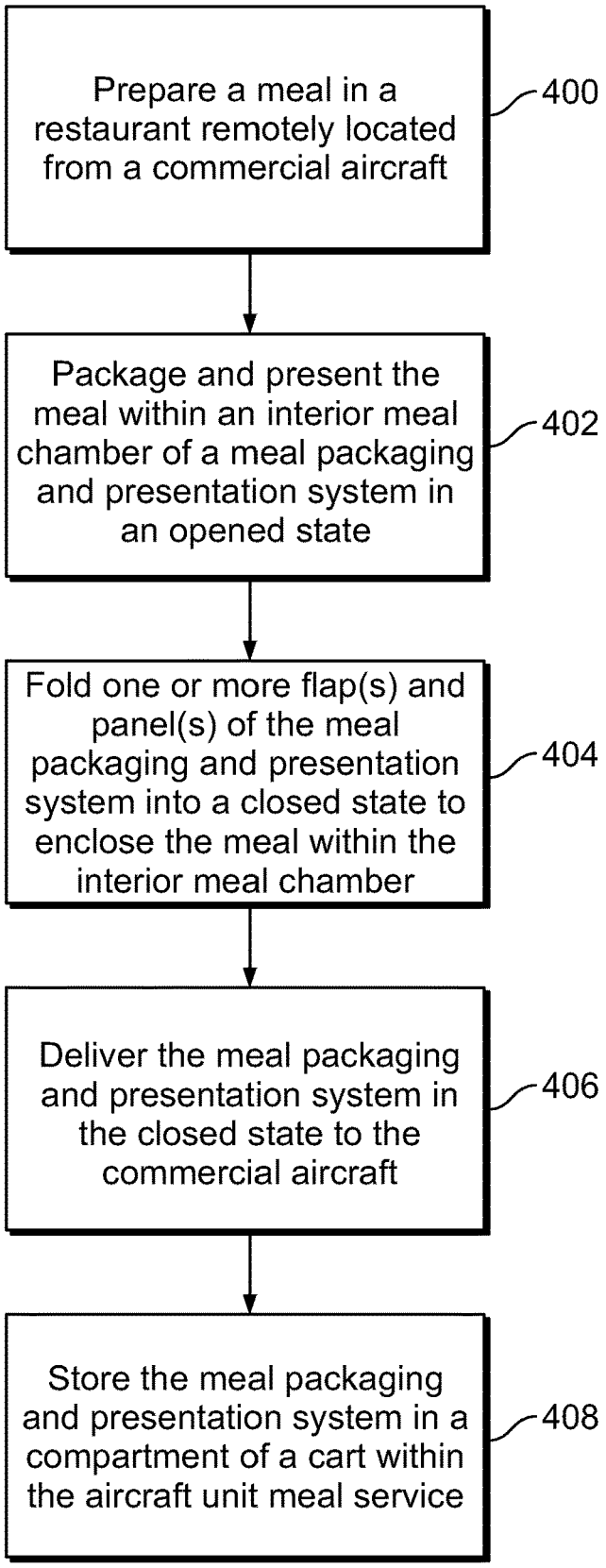
FIG. 8 illustrates a flow chart of a meal packaging and presentation method, according to an embodiment of the present disclosure.

FIG. 8 illustrates a flow chart of a meal packaging and presentation method, according to an embodiment of the present disclosure. At 400, a meal is prepared in a facility (such as restaurant) that is remotely located from a commercial aircraft. At 402, the meal is packaged and presented within an interior meal chamber of a meal packaging and presentation system in an opened state. At 404, one or more flap(s) and/or panel(s) of the meal packaging and presentation system are folded into a closed state to enclose the meal within the interior meal chamber. At 406, the meal packaging and presentation in the closed state is delivered to the commercial aircraft. At 408, the meal packaging and presentation system in the closed state is stored in a compartment of a cart within the aircraft until meal service, when served to a passenger.

As described herein, embodiments of the present disclosure provide systems and methods for efficiently packaging and presenting meals to individuals, such as within a commercial aircraft. Further, embodiments of the present disclosure provide systems and methods that reduce the need for flight attendants to prepare and present meals during a flight, thereby allowing the flight attendants to perform other tasks.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A meal packaging and presentation system, comprising:

a base;

one or more panels coupled to the base; and one or more flaps coupled to one or both of the one or more panels or the base, wherein the base, the one or more panels, and the one or more flaps in a closed state define an interior meal chamber, wherein the interior meal chamber is inside the base, the one or more panels, and the one or more flaps in the closed state, wherein the one or more panels and the one or more flaps are configured to dangle downwardly from the base when the base, the one or more panels, and the one or more flaps are in an opened presentation state, wherein the interior meal chamber provides at least one meal organizer retaining a plurality of items associated with a prepared meal securely within the interior meal chamber, wherein the plurality of items associated with the prepared meal comprises a plurality of items of dishware and a plurality of food items, and wherein the plurality of items of dishware and the plurality of food items are retained by the at least one meal organizer within the interior meal chamber, wherein the one or more panels and the one or more flaps comprise:

a front panel connected to the base at a low front edge seam;

a first side panel connected to the base at a first low side edge seam;

a second side panel connected to the base at a second low side edge seam;

a rear panel connected to the base at a low rear edge seam;

a first top flap connected to the first side panel at a first top side edge seam;

a second top flap connected to the second side panel at a second top side edge seam;

a front top flap connected to the front panel at a top front edge seam; and a rear top flap that connects to the rear panel at a top rear edge, wherein the interior meal chamber is formed between the base, the front panel, the first side panel, the second side panel, the rear panel, the first top flap, and the second top flap when the meal packaging and presentation system is in a closed state, and wherein the meal packaging and presentation system is configured to transition between the closed state and an opened presentation state through manipulation of the front panel, the first side panel, the second side panel, the rear panel, the first top flap, the second top flap, the front top flap, and the rear top flap.

2. The meal packaging and presentation system of claim 1, formed of recyclable or compostable cardboard.

3. The meal packaging and presentation system of claim 1, wherein a first interior edge of the first top flap is proximate to a second interior edge of the second top flap when the meal packaging and presentation system is in the closed state.

4. The meal packaging and presentation system of claim 1, further comprising a tamper-evident seal secured over portions of the first top flap and the second top flap when the meal packaging and presentation system is in the closed state, wherein the seal couples the first top flap and the second top flap together in a closed position.

5. The meal packaging and presentation system of claim 1, further comprising an indicator that is configured to identify a status indication, indication of origin, contents within the interior meal chamber, and an individual to whom the meal packaging and presentation system is to be served.

6. The meal packaging and presentation system of claim 5, wherein the indicator is secured to an exterior surface of the front panel.

7. The meal packaging and presentation system of claim 1, wherein one or more portions of the front panel, the first side panel, the second side panel, the rear panel, the first top flap, or the second top flap are transparent.

8. The meal packaging and presentation system of claim 1, wherein the meal packaging and presentation system in the closed state is sized and shaped to be received and retained within a compartment of a galley cart of a commercial aircraft.

9. The meal packaging and presentation system of claim 1, wherein the first top flap is configured to be pivoted open laterally in relation to the first side panel about and along the first top side edge seam, wherein the second top flap is configured to be pivoted open laterally in relation to the second side panel about and along the second top side edge seam.

10. The meal packaging and presentation system of claim 9, wherein the front top flap is configured to be pivoted open forwardly in relation to the front panel, and wherein the rear top flap is configured to be pivoted open rearwardly in relation to the rear panel, wherein the interior meal chamber is exposed when front top flap, the second top flap, the front top flap, and the rear top flap are opened.

11. The meal packaging and presentation system of claim 1, wherein at least a portion of the plurality of items of dishware is formed of recyclable cardboard.

12. The meal packaging and presentation system of claim 1, wherein the front top flap and the front panel are configured to be outwardly unfolded into a flattened position.

13. The meal packaging and presentation system of claim 12, wherein the front top flap and the front panel outwardly unfolded into the flattened position provide a lap protector.

14. The meal packaging and presentation system of claim 1, wherein the first side panel and the second top flap are configured to be outwardly unfolded into a first flattened position, and wherein the second side panel and the second top flap are configured to be outwardly unfolded into a second flattened position.

15. The meal packaging and presentation system of claim 1, further comprising one or more item stabilizing channels that are configured to retain at least a portion of the plurality of items of dishware in a stable, upright position.

16. The meal packaging and presentation system of claim 15, wherein the one or more item stabilizing channels are formed through one or both of the rear panel and the rear top flap.

17. The meal packaging and presentation system of claim 1, wherein one or more of the low front edge seam, the first low side edge seam, the second low side edge seam, the low rear edge seam, the first top side edge seam, and the second top side edge seam comprise perforations.

18. The meal packaging and presentation system of claim 1, wherein interior surfaces of the base, the first top flap, the first side panel, the second side panel, and the second top flap provide a dining mat.

19. A meal packaging and presentation system formed of recyclable or compostable cardboard, the meal packaging and presentation system comprising:

a base;

a front panel connected to the base at a low front edge seam;

a first side panel connected to the base at a first low side edge seam;

a second side panel connected to the base at a second low side edge seam;

a rear panel connected to the base at a low rear edge seam;

a first top flap connected to the first side panel at a first top side edge seam, wherein the first top flap is configured to be pivoted open laterally in relation to the first side panel about and along the first top side edge seam;

a second top flap connected to the second side panel at a second top side edge seam, wherein the first side panel and the second top flap are configured to be outwardly unfolded into a first flattened position, wherein the second top flap is configured to be pivoted open laterally in relation to the second side panel about and along the second top side edge seam, wherein a first interior edge of the first top flap is proximate to a second interior edge of the second top flap when the meal packaging and presentation system is in a closed state, wherein the second side panel and the second top flap are configured to be outwardly unfolded into a second flattened position;

a seal secured over portions of the first top flap and the second top flap when the meal packaging and presentation system is in the closed state, wherein the seal couples the first top flap and the second top flap together in a closed position;

an indicator secured to an exterior surface of the front panel;

a front top flap connected to the front panel at a top front edge seam, wherein the front top flap is configured to be pivoted open forwardly in relation to the front panel, wherein the top front flap and the front panel are configured to be outwardly unfolded into a flattened position to provide a lap protector; and a rear top flap that connects to the rear panel at a top rear edge, wherein the rear top flap is configured to be pivoted open rearwardly in relation to the rear panel;

dishware formed of recyclable or compostable cardboard; and one or more item stabilizing channels that are configured to retain at least a portion of the dishware in a stable, upright position, wherein the one or more item stabilizing channels are formed through one or both of the rear panel and the rear top flap, wherein interior surfaces of the base, the first top flap, the first side panel, the second side panel, and the second top flap provide a dining mat, wherein an interior meal chamber is formed between the base, the front panel, the first side panel, the second side panel, the rear panel, the first top flap, and the second top flap when the meal packaging and presentation system is in the closed state, wherein the dishware is within the interior meal chamber, wherein the indicator is configured to identify one or both of contents within the interior meal chamber or an individual to whom the meal packaging and presentation system is to be served, wherein the meal packaging and presentation system in the closed state is sized and shaped to be received and retained within a compartment of a galley cart of a commercial aircraft; and wherein the meal packaging and presentation system is configured to transition between the closed state and an opened presentation state through manipulation of the front panel, the first side panel, the second side panel, the rear panel, the first top flap, the second top flap, the front top flap, and the rear top flap.

20. The meal packaging and presentation system of claim 18, wherein one or more portions of the front panel, the first side panel, the second side panel, the rear panel, the first top flap, or the second top flap are transparent.

* * * * *